US005120291A

United States Patent [19]

Wada et al.

[11] Patent Number: 5,120,291

[45] Date of Patent: Jun. 9, 1992

[54] CHOPPER FOLDING MACHINE WITH BAD FOLD DETECTING

[75] Inventors: Kyoji Wada; Masashi Kanazawa; Masataka Sugiyama, all of Kanagawa, Japan

[73] Assignee: Toshiba Kikai Kabushiki Kaisha, Tokyo, Japan

[21] Appl. No.: 506,810

[22] Filed: Apr. 10, 1990

[30] Foreign Application Priority Data

Apr. 11, 1989 [JP] Japan ..... 1-091459
Mar. 20, 1990 [JP] Japan ..... 2-72485
Mar. 20, 1990 [JP] Japan ..... 2-72486

[51] Int. Cl.[5] ..... B31F 1/10; B31F 7/00

[52] U.S. Cl. ..... 493/23; 493/14; 493/20; 493/444; 493/445

[58] Field of Search ..... 493/19-20, 493/15, 23, 30, 444, 445, 12, 13-14, 419, 420, 421; 475/150, 154, 156; 271/227, 261

[56] References Cited

U.S. PATENT DOCUMENTS 2,072,235 3/1937 Wormser ..... 271/261
3,176,977 4/1965 Graf et al. ..... 493/444
3,424,632 1/1969 Adler ..... 493/444
3,632,104 1/1972 Dufour ..... 493/444
3,926,425 12/1975 Pierce et al. ..... 493/444
4,201,378 5/1980 Hams ..... 271/261
4,496,337 1/1985 Meenen ..... 493/23
4,509,939 4/1985 Miller ..... 493/444
4,573,671 3/1986 Reponty ..... 493/23
4,578,052 3/1986 Engel et al. ..... 493/23
4,602,778 7/1986 Hirose et al. ..... 271/261 X
4,657,236 4/1987 Hirakawa et al. ..... 271/261 X
4,738,442 4/1988 Rodi et al. ..... 271/281

FOREIGN PATENT DOCUMENTS 0064450 4/1984 Japan .
0225049 9/1988 Japan .

*Primary Examiner*—Bruce M. Kisliuk
*Assistant Examiner*—John A. Marlott
*Attorney, Agent, or Firm*—Cushman, Darby & Cushman

[57] ABSTRACT

A chopper folding machine including a chopper blade and a conveyor belt driven synchronously by a drive system for a folding apparatus put in juxtaposition with a printing machine, and a timing adjusting device provided in a drive system for at least one of the chopper blade and the conveyor belt for adjusting the timing of chopper folding. Thus, the timing of the conveyance of a signature, to be folded, by the conveyor belt and that of vertical movement of the chopper blade are adjusted.

10 Claims, 10 Drawing Sheets

CHOPPER FOLDING MACHINE WITH BAD FOLD DETECTING

BACKGROUND OF THE INVENTION

1. Field of the Invention

The present invention relates to a chopper folding machine in a folding apparatus put in juxtaposition with a printing machine, and more particularly to a chopper folding machine which adjusts the timing of chopper folding effectively and is capable of detecting an inferior signature.

2. Description of the Related Art

In a conventional rotary press printing machine, a chopper blade and a conveyor belt of a chopper folding machine are driven synchronously using a driving system for the folding apparatus to cause conveyance of a signature, to be folded, by the conveyor belt and vertical movement of the chopper blade to be timed in order to perform chopper folding.

If the speed of the conveyor belt changes depending on a change in the printing speed, the timing of chopper folding of the signature may deviate from a reference one due to slippage of the signature on the belt, the inertia of the signature, etc. This may cause the signature to be broken or damaged to thereby provide a bad product. Thus, when the timing of the chopper folding deviates, it is necessary to time vertical movement of the chopper blade and conveyance of the signature.

Conventionally, the adjustment of such timing is performed by adjusting the meshing of bevel gears provided in the drive system for the chopper blade, namely, by moving one movable bevel gear relative to another fixed bevel gear to change the meshing and hence the phase angle of rotation of the chopper blade drive system to thereby adjust the vertical movement of the chopper blade.

However, the range of adjustment of the phase angles by changing the meshing of the bevel gears is proportional to their lead angles, whereas the range of movement of the movable bevel gear is limited to within the range of meshing of the fixed gear, so that if a deviation of the timing of chopper folding exceeds a limit, it is impossible to adjust the timing of chopper folding. Therefore, the machine must be stopped temporarily to adjust the timing, disadvantageously.

The adjustment of the timing of chopper folding is performed by the operator of the folder by visually observing the moment of chopper folding, namely, the timing at which the signature and the chopper blade contact and adjusting the meshing of the bevel gears if a deviation of the timing is found.

However, when the timing of chopper folding is observed visually, it cannot be found unless the deviation of the timing exceeds a certain value. Therefore, it takes significant time to find the deviation of the timing, so that the deviation becomes large and bad folding is likely to occur. Since it is difficult to automatically detect bad products such as broken or damaged ones, products will include both good and bad ones and, therefore, all the products must be inspected undesirably.

A personnel who supervises the timing of chopper folding, and hence the personnel expenditure, etc., are required. In addition, the personnel must supervise the chopper blade, etc., operating at considerably high speeds, which is a burden on him.

Furthermore, if the leading edge of the conveyed signature is tilted or not perpendicular to the conveyance direction, the chopper blade would fold the signature diagonally. In order to cope with this situation, a chopper stopper is provided above the conveyor belt to cause the signature to abut against the stopper to thereby correct the tilt of the sheet.

If the tilt of the signature is corrected by causing the sheet to abut against the stopper, it can be corrected so long as it is within a predetermined range. However, it cannot be corrected even if the sheet abuts against the chopper stopper if the tilt exceeds the predetermined range, and hence bad folding would occur undesirably. Therefore, the articles would include badly folded ones and hence all the articles must be inspected.

It is a first object of the present invention to provide a chopper folding machine which is capable of adjusting the timing of conveyance of the signature by the conveyor belt and of vertical movement of the chopper blade in a continuous stepless limitless manner and hence the timing of chopper folding without stopping the machine during the operation of the machine.

It is a second object of the present invention to provide a chopper folding machine which is capable of automatically adjusting the timing of chopper folding without relying on the operator.

It is a third object of the present invention to provide a chopper folding machine which is capable of automatically detecting a badly folded signature due to its tilt.

SUMMARY OF THE INVENTION

A chopper folding machine as a preferred embodiment of the present invention comprises a chopper blade and a conveyor belt driven synchronously by a drive system for a folding apparatus put in juxtaposition with a printing machine; and a differential mechanism including timing adjusting means provided in a drive system for at least one of the chopper blade and the conveyor belt for adjusting the timing of chopper folding whereby the timing of the conveyance of a signature, to be folded, by the conveyor belt and of vertical movement of the chopper blade is adjusted.

In the present invention providing such structure, the timing of chopper folding is maintained constant unless a differential mechanism provided in a drive system for at least one of the chopper blade and the conveyor belt is operated because the chopper blade and the conveyor belt are driven synchronously by the drive system for the folding apparatus.

If the differential mechanism is operated, its output is adjusted in a continuous stepless limitless manner, so that the timing of chopper folding is also adjusted in a continuous stepless limitless manner. Therefore, even if the timing of vertical movement of the chopper blade and that of conveyance of the signature by the conveyor belt deviates from a desirable one due to a change in the speed of the conveyor belt, for example, the differential mechanism is operated to adjust the timing of chopper folding without stopping the machine.

The differential gear mechanism may include an output gear fastened to a shaft connected to the drive system for the folding apparatus; a first inner-tooth gear having an outer teeth meshing with the output gear and supported rotatably on a non-eccentric portion of an eccentric shaft having an eccentric portion; an eccentric gear meshing with the inner teeth of the first inner-tooth gear and supported rotatably on the eccentric portion of the eccentric shaft; and a second inner gear having inner teeth meshing with the eccentric gear and outer teeth meshing with a gear train on the side of the chopper blade and supported rotatably on the non-eccentric portion of the eccentric shaft; wherein the first and second inner-tooth gears have inner teeth which are same in pitch circle and different in number; and wherein the chopper blade moves vertically via a gear train meshing with the outer teeth of the second inner-tooth gear.

The eccentric shaft of the differential gear mechanism may be driven by a servomotor which is controlled by a computer or driven by the rotation of a crank handle attached removably to an end of the eccentric shaft.

Another chopper folding machine according to the present invention includes a chopper blade and a conveyor belt driven synchronously by a drive system for a folding apparatus put in juxtaposition with a printing machine, and timing correcting means which includes timing adjusting means provided in a drive system for at least one of the chopper blade and the conveyor belt for adjusting the timing of chopper folding; a sensor for sensing an edge of a signature, to be folded, conveyed by the conveyor belt; a rotational angle detector for detecting the rotational angle of a shaft moving the chopper blade vertically; rotational angle detecting means for detecting from the rotational angle detector the rotational angle of the shaft when the sensor has sensed the signature; timing adjusting quantity calculating means for calculating a timing adjusting quantity from a preset value and the rotational angle detected by the rotational angle detecting means; and drive control means for driving and controlling the timing adjusting means in accordance with the timing adjusting quantity.

In the present invention providing such arrangement, the chopper blade and the conveyor belt of the chopper folding machine are driven synchronously by the drive system for the folding apparatus. Therefore, the rotational angle of the shaft is constant when the sensor has sensed the signature if the timing of chopper folding is constant. The rotational angle conforming to the timing of chopper folding is set as a preset value.

When the folding apparatus is operated and the signature conveyed by the conveyor belt is sensed by the sensor, a predetermined signal is conveyed from the sensor to the rotational angle detecting means, which detects the rotational angle of the shaft from the rotational angle detector in accordance with the signal from the sensor. The timing adjusting quantity setting means calculates the magnitude of deviation of the timing, or the timing adjusting quantity, from the difference between the rotational angle and the present value.

The drive control means drives and controls the timing adjusting means in accordance with the timing adjusting quantity to thereby automatically correct the timing of the chopper folding to a preset timing to eliminate the deviation of the timing and hence prevent the production of badly folded signatures.

The timing adjusting means is preferably a differential mechanism and more particularly a differential gear mechanism.

A further chopper folding machine according to the present invention includes a chopper blade and a conveyor belt driven synchronously by a drive system for a folding apparatus put in juxtaposition with a printing machine and bad-folding detecting means for detecting a badly folded signature. The bad-folding detecting means includes a plurality of sensors provided so as to extend perpendicular to the direction in which the signature is conveyed by the conveyor belt, tilt detecting means for detecting an tilt of an end of the sheet of printed paper to the direction, in which the signature is conveyed, in accordance with the outputs from the respective sensors which have sensed the signature, and determining means for determining bad folding of the signature depending on its tilt detected by the tilt detecting means.

In the present invention providing such arrangement, when the signature is conveyed tilted on the conveyor belt, the timing at which the respective sensors sense the signature differ from one another. The tilt detecting means calculates the difference between the moments of detection as the difference between the rotational angles of the shaft, or between the times, when the respective sensors have the signature, and detects the tilt of the signature from the difference. The determining means determines that the folding of the sheet of paper is bad if the tilt is larger than a predetermined one, namely, if the tilt cannot be corrected even if the signature is caused to abut against the chopper stopper, to thereby detect and eliminate the badly folded sheet of paper before it becomes a final product.

The bad-folding detecting means includes a rotational angle detector which detects the rotational angle of a shaft for moving the chopper arm vertically. The tilt detecting means preferably calculates from the rotational angle detector the respective rotational angles of the shaft when the respective sensors have sensed the signature, and detects the tilt of the signature from the difference between those rotational angles.

The tilt detecting means of the folding detecting means may calculate the tilt of the signature from the difference between the times when the respective sensors have sensed the signature and the conveyance speed of the conveyor belt.

BRIEF DESCRIPTION OF THE DRAWINGS

FIGS. 1 through 3 illustrate a first embodiment of the present invention in which;

FIG. 1 schematically illustrates the entire structure of a chopper folding machine;

FIGS. 2 is a plan view indicative of the structure of the drive system and differential mechanism of a chopper blade;

FIG. 3 is a view of the chopper blade and associated elements as viewed in the direction of Z-arrow of FIG. 2;

FIGS. 4 and 5 illustrate a second embodiment of the present invention in which;

FIG. 4 schematically illustrates the entire structure of a chopper folding machine;

FIG. 5 is a plan view indicative of the structure of the drive system and differential mechanism of the chopper arm;

DETAILED DESCRIPTION OF THE PREFERRED EMBODIMENTS

A first preferred embodiment of the present invention will now be described with reference to the drawings.

Figure 1:
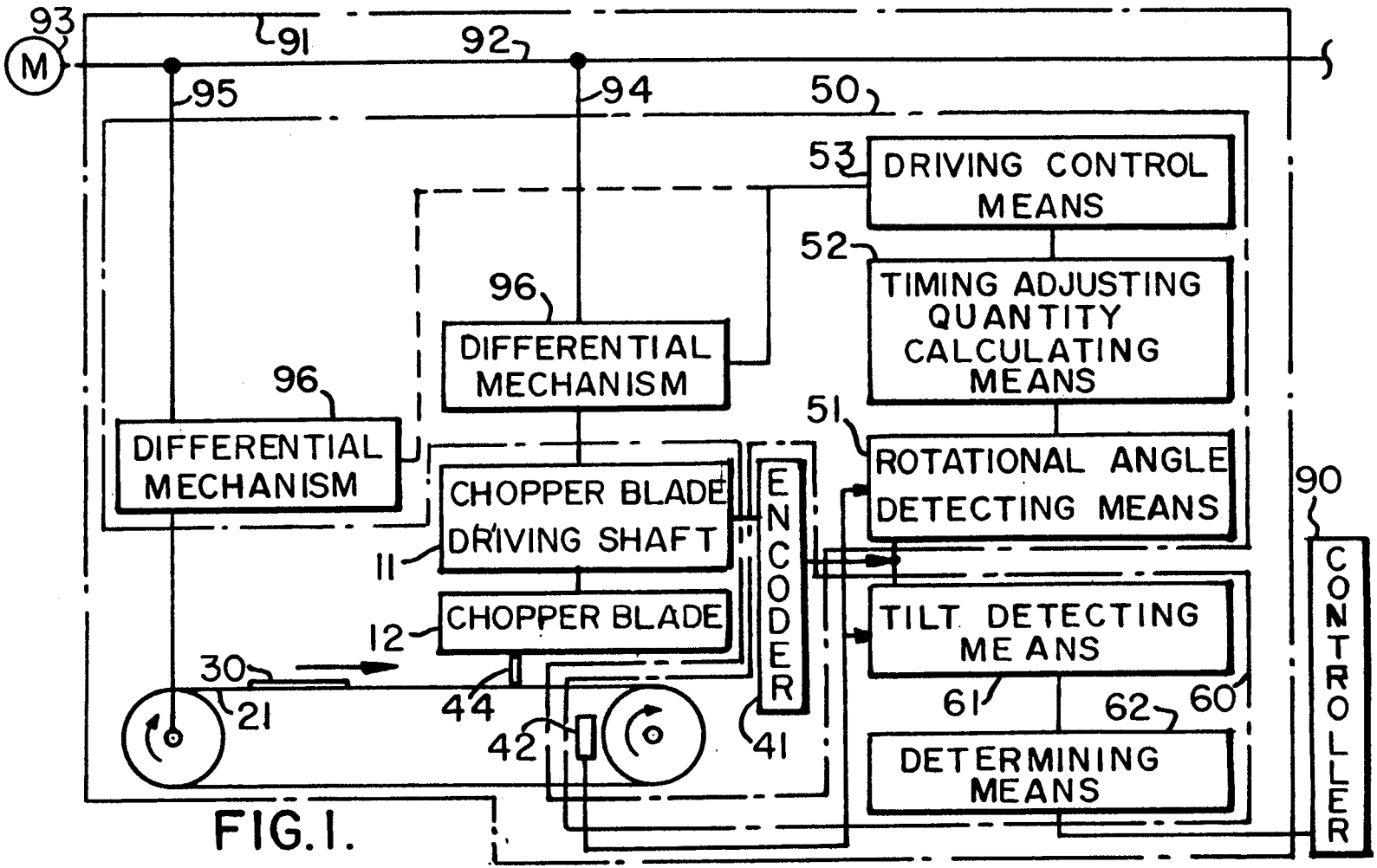

FIG. 1 illustrates the structure of a chopper folding machine 91 according to the present invention. A folding apparatus which includes the chopper folding machine 91 is driven by a drive system 92 connected to a motor 93 of a printing machine. Connected to the drive system 92 are a drive system 94 for a chopper blade 12, a drive system 95 for a conveyor belt 21 which conveys a signature 30 to be folded, etc.

The drive system 94 for the chopper blade 12 includes a differential mechanism 96 comprising a differential gear as timing adjusting means and a chopper blade driving shaft 11 which moves the chopper arm 12B upward and downward. A differential mechanism 96 may be provided in the drive system 95 for the conveyor belt 21 as shown in FIG. 1 or may be provided in the respective drive systems 94 and 95. Connected to the chopper blade driving shaft 11 is an encoder 41 comprising a rotational angle detector which detects rotational angle of the shaft 11.

Figure 2:
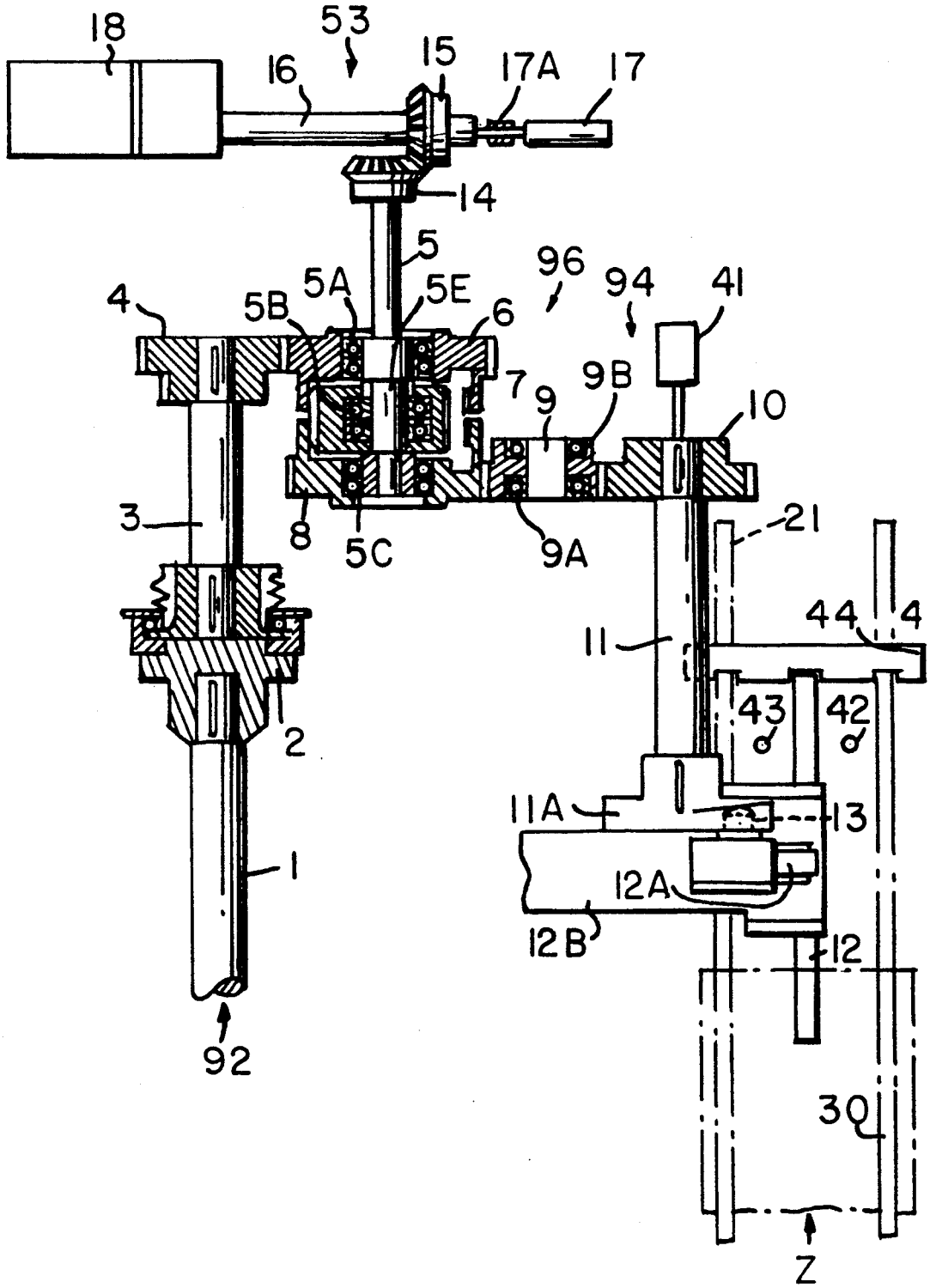

A pair of beam sensors 42 and 43 are disposed over the conveyor belt 21 such that they extend perpendicular to the direction, where the signature 30 is conveyed, along the corresponding edges of the sheet of paper at predetermined positions equi-spaced from the center of the belt 21 before a chopper stopper 44 disposed above the belt 21, as shown in FIG. 2.

The respective outputs from the beam sensors 42, 43 and from the encoder 41 are connected to rotational angle detecting means 51 which detects the rotational angle of the chopper blade driving shaft 11 and to tilt detecting means 61 which detects a tilt of the signature 30, as shown in FIG. 1.

Connected to the rotational angle detecting means 51 is timing adjusting quantity calculating means 52 to which drive control means 53 is connected which drives and controls the differential mechanism 96.

Determining means 62 which determines a badly folded signature 30 is connected to the tilt detecting means 61.

The encoder 41, the beam sensors 42, 43, the rotational angle detecting means 51, the timing adjusting quantity calculating means 52, the drive control means 53 and the differential mechanism 96 compose timing correcting means 50. The encoder 41, the beam sensors 42, 43, the tilt detecting means 61 and the determining means 62 compose bad-folding detecting means 60. A controller 90 of the printing machine is connected to the determining means 62.

Figure 3:
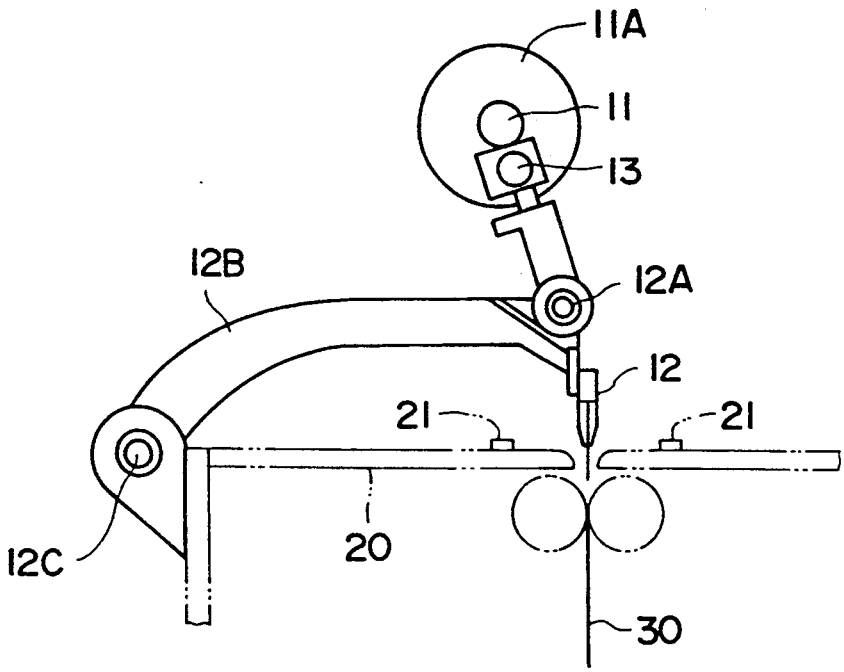

FIG. 2 shows the drive system 94 for and the differential mechanism 96 for the chopper blade 12, and FIG. 3 is a view of the chopper blade 12 and associated elements as viewed in the direction of arrow Z in FIG. 2.

In FIG. 2, a shaft 1 of the drive system 92 in the folder is coupled to a shaft 3 of the drive system 94 through a torque limiter 2 with an output gear 4 fastened to an end of the shaft 3.

The gear 4 meshes with the outer teeth of a first inner-tooth gear 6 which is supported rotatably through a bearing 5A in a non-eccentric portion of an eccentric shaft 5 which is supported rotatably in a fixed frame (not shown).

The inner teeth of the first inner-tooth gear 6 mesh with an eccentric gear 7 supported rotatably through a bearing 5B in an eccentric portion 5E of the eccentric shaft 5. The eccentric gear 7 meshes with the inner teeth of a second inner-tooth gear 8 supported rotatably through a bearing 5C in the non-eccentric portion of the eccentric shaft 5. The inner teeth of the second inner-tooth gear 8 are equal in pitch circle to those of the first inner-tooth gear 6 and one tooth fewer than the latter; namely, the gear 8 is a so-called profile shifted gear.

The outer teeth of the second inner-tooth gear 8 mesh with a gear 9B supported through a bearing 9A on a shaft 9 while the gear 9B meshes with a gear 10 fastened to one end of the chopper blade driving shaft 11.

The encoder 41 is attached to one end of the chopper blade driving shaft 11 to the other end of which a flange 11A in the form of a substantial disk is fastened to which an eccentric pin 13 is, in turn, fastened.

The eccentric pin 13 is supported by a bearing 12A fastened to one end of the chopper arm 12B, as shown also in FIG. 3. The chopper arm 12B has a chopper blade 12 at one end and is supported at the other end rotatably in a bearing 12C fixed to a conveyor table 20. Disposed on the table 20 is the conveyor belt 21 driven by the drive system 95 to convey the signature 30.

Fastened to one end of the eccentric shaft 5 is a bevel gear 14 which meshes with a bevel gear 15 fastened to the output shaft 16 of a motor 18. A potentiometer 17 is connected to the output shaft 16 via a coupling 17A.

The gear 4, the eccentric shaft 5, the first and second inner-tooth gears 6 and 8 and the eccentric gear 7 compose the differential mechanism 96. The potentiometer 17 and the motor 18 compose drive control means 53.

The operation of the present embodiment will now be described.

A set value X for the timing of chopper folding is set in the timing adjusting quantity calculating means 52. The set value X is set as the rotational angle of the chopper blade driving shaft 11 when the signature 30 is sensed by the beam sensors 42 and 43 depending on the distance x mm between the signature 30 and the chopper stopper 44 when the signature 30 contacts the chopper blade 12.

An allowable value Y for a tilt of the signature 30 is set in the determining means 62. The valve Y indicates a rotational angle of the chopper blade driving shaft 11 to which an allowable quantity of tilt y mm of the signature 30 is converted.

When the folding apparatus is driven, the rotation of the drive system 92 thereof is transmitted to the shaft 1, and then to the shaft 3 of the drive system 94 via the torque limiter 2 to thereby rotate the gear 4 the rotation of which is transmitted sequentially to the first inner-tooth gear 6, eccentric gear 7, second inner-tooth gear 8, gears 9B and 10 finally to the chopper blade driving shaft 11 without rotating the eccentric shaft 5.

As seen in FIG. 3, rotation of the chopper blade driving shaft 11, the chopper arm 12B connected by the eccentric pin 13 provided on the flange 11A to pivot up and down around the bearing 12C to thereby move the chopper blade 12 up and down.

On the other hand, the conveyor belt 21 is driven by the drive system 95 branching from the shaft 1 and hence the signature 30 is conveyed while sequentially folded by the blade 12 of the swinging chopper arm 12B to thereby perform continuous chopper folding.

When the beam sensors 42, 43 sense the leading end of the signature 30, they send a predetermined signal to the rotational angle detecting means 51 and to the tilt detecting means 61, which detect the rotational angles $\alpha$, $\beta$ of the crank shaft 11 when the respective sensors 42, have sensed the signature 30 in accordance with the signals from the sensors 42, 43.

The rotational angle detecting means 51 calculates the average rotational angle $\theta-(\alpha+\beta)/2$ of the chopper blade driving shaft 11 when the signature 30 is detected. The timing adjusting quantity calculating means 52 calculates the difference between the preset value X and the average rotational angle 0, namely the timing correction quantity, by $$X-\theta=(X-(\alpha+\beta)/2) \quad (1)$$

The drive control means 53, or the motor 18 and potentiometer 17, controls the rotational direction and angle of the eccentric shaft 5 of the differential mechanism 96 in accordance with the correction quantity.

By rotation of the eccentric shaft 5, the eccentric gear 7 supported by the eccentric portion 5E of the eccentric shaft 5 rolls along the inner teeth of the first and second inner-tooth gears 6 and 8. At this time, the second inner-tooth gear 8 is one tooth fewer than the first inner-tooth gear 6, so that there occurs a difference in movement between the first and second inner-tooth gears 6 and 8 in the rotational direction due to the rolling of the eccentric gear 7.

The rotation of the second inner-tooth gear 8 the rotational phase of which is different from that of the inner-tooth gear 6 or the shaft 1 is transmitted to the gears 9B, 10, the shaft 11, the flange 11A and the eccentric pin 13 to swing the chopper arm 12B around the bearing 12C to thereby move the chopper blade 12 upward and downward.

Therefore, the rotational phase of the drive system 94 for the chopper blade 12 relative to the drive system 95 for the conveyor belt 21 is adjusted to thereby automatically correct the timing of chopper folding.

The tilt detecting means 61 calculates the absolute value $|\alpha-\beta|$ of the difference between the rotational angles $\alpha$ and $\beta$ while the determining means 62 compares the preset allowable value Y and the absolute value $|\alpha-\beta|$. If the signature 30 is conveyed normally without being tilted, the sensors 42, 43 detect the signature 30 simultaneously. Therefore, the rotational angles $\alpha$ and $\beta$ of the chopper blade driving shaft 11 become equal and hence the absolute value $|\alpha-\beta|$ of the difference between the rotational angles $\alpha$ and $\beta$ becomes 0. If the signature 31 is tilted, the absolute value $|\alpha-\beta|$ becomes larger than 0.

The determining means 62 determines that the signature 30 is badly folded if the absolute value $|\alpha-\beta|$ is larger than the allowable value Y. The controller 90 eliminates the signature 30, determined badly folded, in the subsequent line.

The present embodiment having such structure produces the following advantages:

Since the differential mechanism 96 is provided in the drive system 94 for the chopper blade 12, the rotational phase of the drive system 94 for the chopper blade 12 is adjusted in a continuous stepless limitless manner in contrast to the drive system 95 for the conveyor belt 21 which conveys the signature 30. Therefore, the timing of chopper folding is adjusted freely without stopping the machine.

Since the timing correction means 50 is provided in the chopper folding machine 91, a deviation of the timing of chopper folding, if any, is detected immediately and corrected automatically. Therefore, bad folding and hence inclusion of bad products among good ones due to deviation of the timing of chopper folding are prevented.

In addition, since bad-folding detecting means 60 is provided, bad folding of a signature 30 due to its tilt is detected steadily and automatically. Therefore, the detected badly folded products are eliminated in the subsequent line and inclusion of bad products among good ones due to the tilt of the corresponding signature is prevented.

Therefore, according to the present embodiment, inclusion of both badly folded products due to deviation of the timing of chopper folding and bad articles due to the tilt of the signatures 30 are eliminated and hence no inspection of all the articles is required.

Since the timing of chopper folding is corrected automatically, no supervisor which supervises chopper folding is required as is done in the conventional folder and hence the personnel expenditure is reduced and the working is performed easily.

Since the differential mechanism 96 is composed of the gear 4, eccentric shaft 5, first and second inner-tooth gears 6, 8, and eccentric gear 7 meshing with the inner teeth of the respective gears 6 and 8, the entire folder is reduced in size. Therefore, the space required for deposition of the differential gear in the folding apparatus is reduced and the folder is easily applicable to the conventional folding apparatus.

Gear 4 should not be limited to the construction shown in FIG. 2. For example, gear 4 may be a spur gear and the inner-tooth gears 6 and 8 so as to reduce manufacturing cost is reduced.

Figure 4:
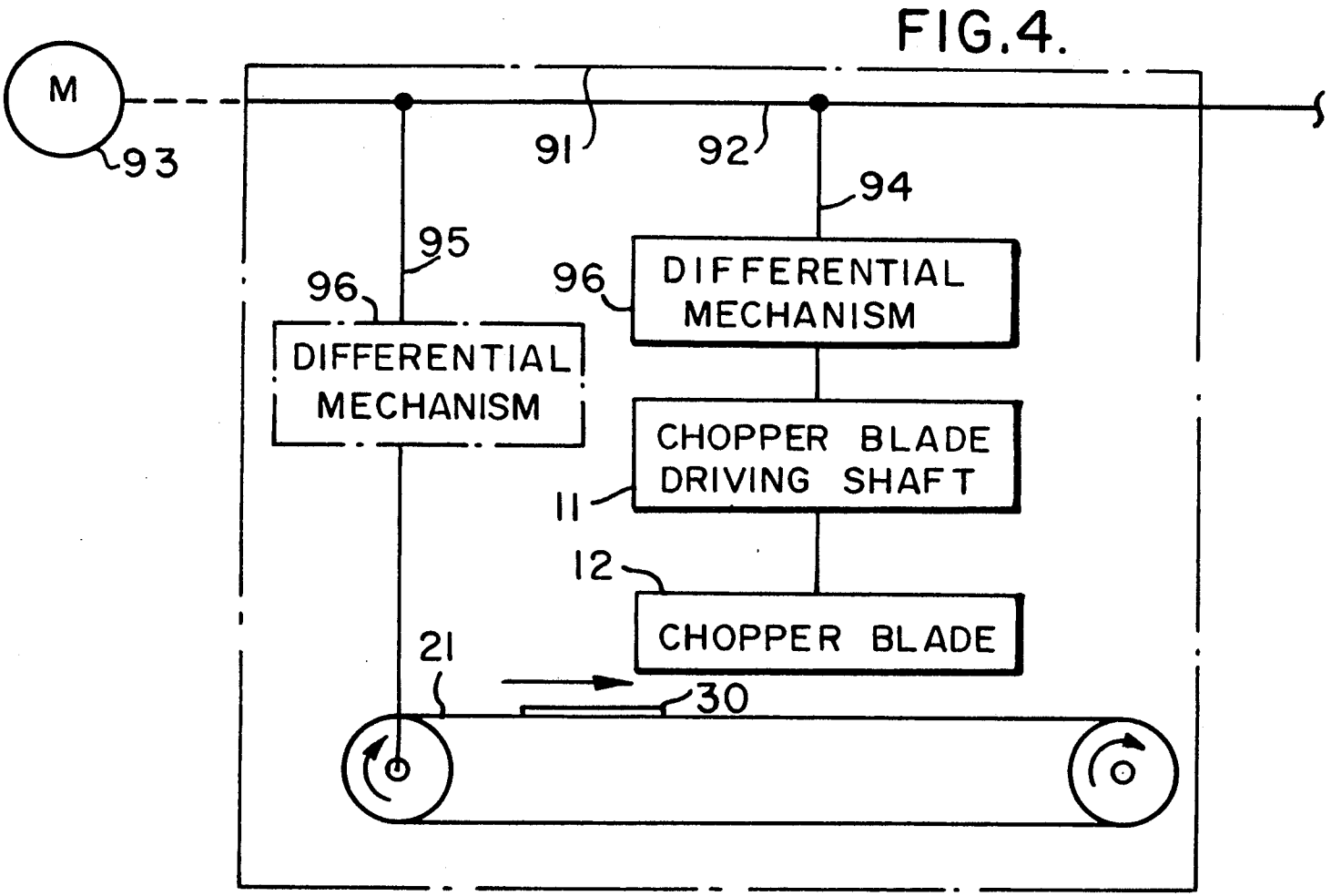
Figure 5:
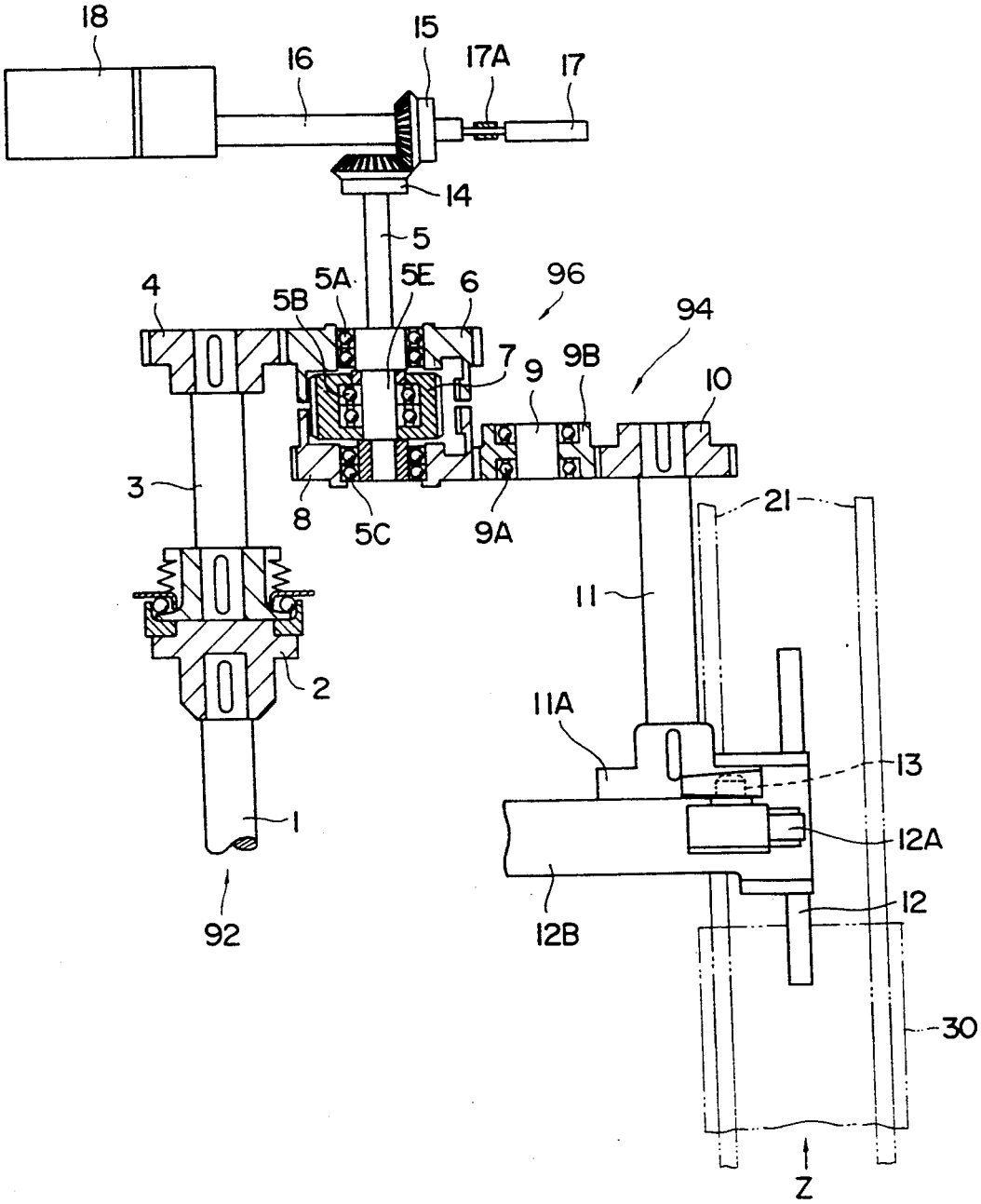

FIGS. 4 and 5 illustrate a second preferred embodiment of the present invention. In the second embodiment, only a differential mechanism 96 is provided and timing correcting means and tilt detecting means such as those 50 and 60 of the first embodiment are not provided In the present embodiment, the operator supervises chopper folding and adjusts the timing of the chopper folding by driving the differential mechanism 96 if the timing deviates. The drive of the differential mechanism 96 is performed by driving the eccentric shaft 5, using the motor 18 and the potentiometer 17 as in the first embodiment.

Also, in the present embodiment, the timing of chopper folding is adjusted in a continuous stepless limitless manner without stopping the machine.

The present invention is not limited to the above respective arrangements of the embodiments and modifications falling in the scope of the present invention in which the object of the present invention is achieved should be included in the present invention.

While, for example, the timing correcting means 50 and the bad-folding detecting means 60 including the differential mechanism 96 are provided in the chopper folding machine 91 in the first embodiment, it should be noted that only one of them may be provided Especially, in the chopper folding machine 91 which conveys the signature 30 without tilting same, only timing correcting means 50 may be provided while only bad-folding detecting means 60 may be provided in the chopper folding machine 91 where no deviation of timing occurs because no change in the speed of the conveyor belt 21 is required.

While in the respective embodiments the differential mechanism 96 is shown and described as being composed of the gear 4, eccentric shaft 5, first and second inner-tooth gears 6, 8 and eccentric gear 7, it should be noted that a differential gear mechanism of another structure may be used.

Figure 6:
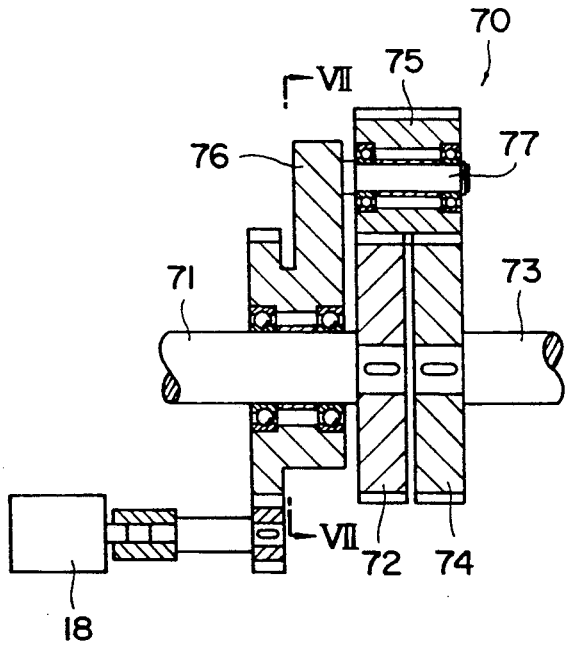
FIG. 6 is a cross sectional view indicative of a modification of the differential mechanism.
Figure 7:
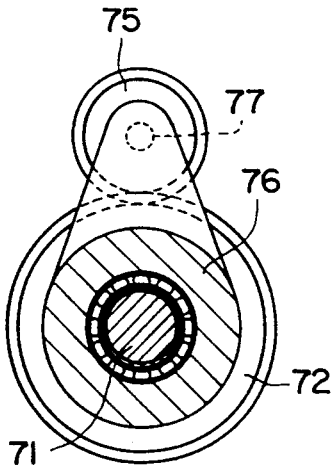
FIG. 7 is a cross section view taken along the line VII—VII of FIG. 6.

As shown in FIGS. 6 and 7, a differential mechanism comprising a differential gear mechanism 70 may be constituted by only outer-teeth gears including a gear 72 fastened to the drive shaft 71 on the side of the drive system 92, a gear 74 fastened to a drive shaft 73 on the side of the chopper blade 12, and a gear 75 meshing with both the gears 72 and 74 without using inner-tooth gears. The gears 72 and 74 are constituted such that they are the same in pitch diameter and differ in number of teeth. The gear 75 is supported rotatably on an eccentric shaft 77 of an arm 76 rotated by the motor 18.

Also, in the differential gear mechanism 70, a difference occurs in the rotations of the drive shaft 71 and 73 to thereby adjust the timing of chopper folding by rotating the arm 76 with the motor 18 to roll the gear 75 along the gears 72 and 74.

Figure 8:
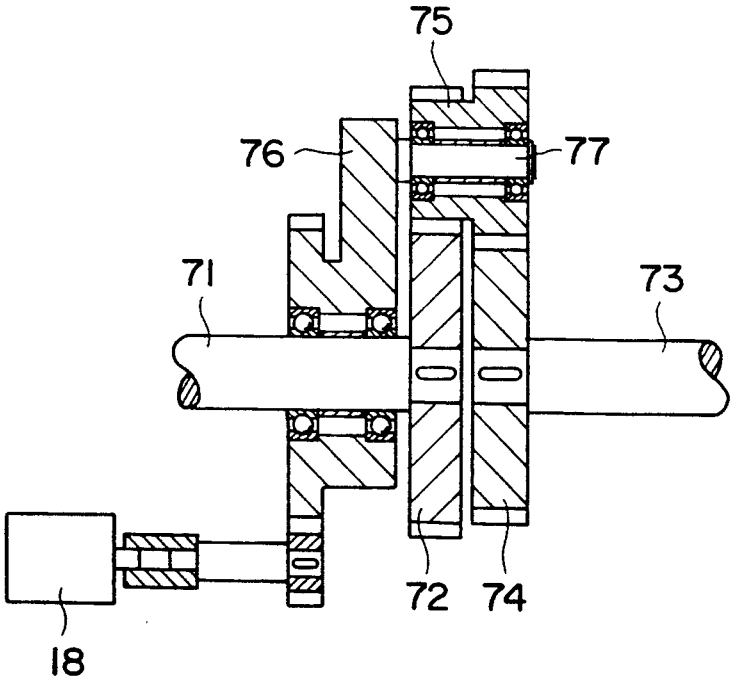
FIG. 8 is a cross section view indicative of another modification of the circumferential mechanism.

As shown in FIG. 8, operational effects similar to those of the differential gear mechanism 70 of FIG. 6 are produced by such an arrangement that the gears 72 and 74 differ in pitch diameter and in number of teeth and such that the gear 75 is a stepped one which meshes with the respective gears 72 and 74.

Figure 9:
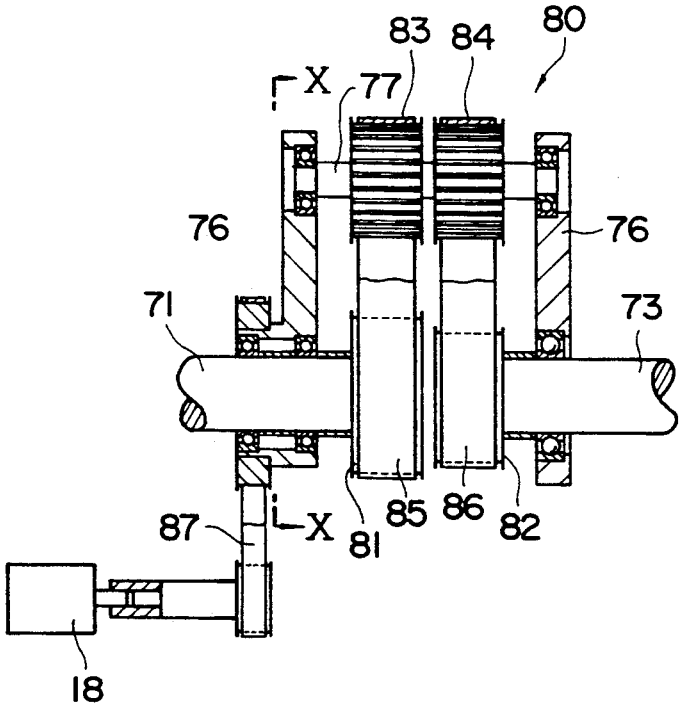
FIG. 9 is a cross section view indicative of a further modification of the differential mechanism.
Figure 10:
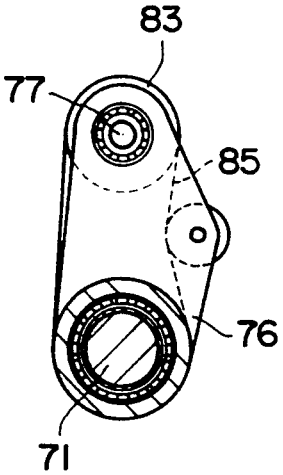
FIG. 10 is a cross section view taken along the line X—X of FIG. 9.

The differential mechanism is not limited to ones using gears. As shown in FIGS. 9 and 10, a differential mechanism 80 may be used which includes timing pulleys 81 and 82 fastened to drive shafts 71 and 73, respectively, timing pulleys 83 and 84 supported rotatably on an eccentric shaft 77 of the arm 76, and timing belts 85 and 86 extending around the timing pulleys 81, 83 and 82, 84, respectively. Also in such differential mechanism 80, the timing of chopper folding is adjusted by rotating the arm 76 through the timing belt 87 with the motor 18.

Figure 12:
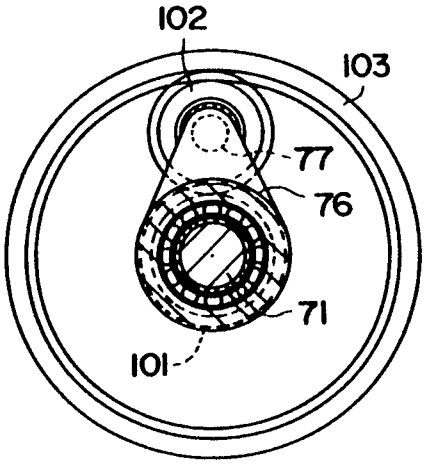
FIG. 12 is a cross section view taken along the line XII—XII of FIG. 11.
Figure 11:
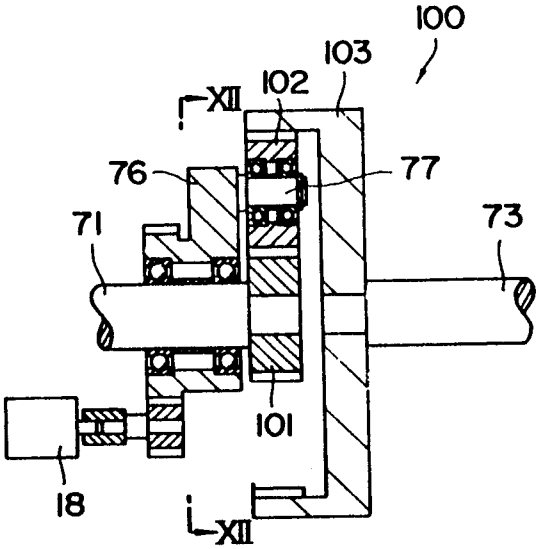
FIG. 11 is a cross section view indicative of a further modification of the differential mechanism.

The differential mechanism may be a so-called planetary gear mechanism 100 including a sun gear 101, a planetary gear 102 and an inner-tooth gear 103, as shown in FIGS. 11 and 12.

Figure 13:
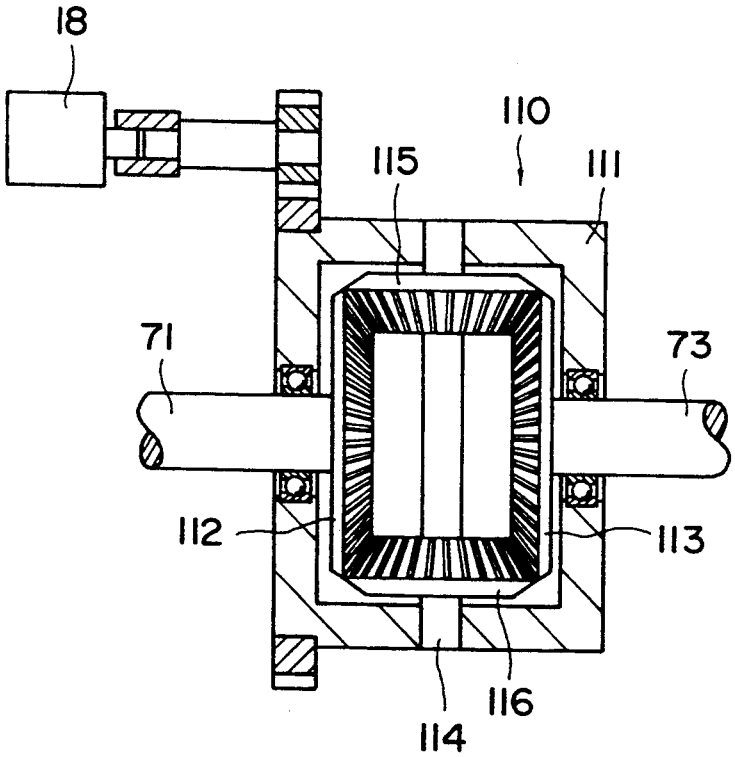
FIG. 13 is a cross section view indicative of a further modification of the differential mechanism.

In addition, as shown in FIG. 13, a differential gear mechanism 110 may be used which is similar in structure to a so-called differential gear of an automobile, including a casing 111 rotated by the motor 18, bevel gears 112, 113 fastened to the drive shafts 71, 73, respectively, and bevel gears 115, 116 meshing with the bevel gears 112 and 113, respectively, supported rotatably on a rotational shaft 114 in the casing 111.

In summary, various kinds of differential mechanisms may be used in the present invention and any one of them may be selected when required.

When the differential gear mechanism is used as the differential mechanism, bevel gears may be used instead of the spur gears.

The timing adjusting means in the first embodiment may be other mechanisms which are capable of adjusting the timing of vertical movement of the chopper blade 12 and is not limited to the illustrated differential mechanism. However, it should be noted that if a differential mechanism is used, timing adjustment is performed in a continuous stepless limitless manner, advantageously.

The source of driving the eccentric shaft 5 is not limited to the motor 18 and the potentiometer 17. For example, generally used well-known pulse motors and AC or DC servomotors available commercially may be used instead. Especially, if no timing adjusting means is provided as in the second embodiment, the timing of chopper folding can be set and maintained in accordance with the kind of a signature 30 to be folded, by numerically controlling the servomotor via a microcomputer, using beforehand preset data corresponding to the quality and thickness of the signature 30 input in the microcomputer.

The timing of chopper folding may be adjusted in the second embodiment by manually rotating a crank handle attached to an end of the eccentric shaft 5 while viewing a scale disk indicating the rotational angle of the eccentric shaft 5 without using the motor, etc. In summary, the drive of the eccentric shaft 5 may be performed either manually or automatically in the chopper folding machine 91 with no timing correcting means 50. It may be selected freely in accordance with operator's demand.

While in the respective embodiments the timing of chopper folding is adjusted by adjusting the timing of vertical movement of the chopper blade 12, using the differential mechanism 96 provided in the drive system 94 for the chopper blade 12, the timing of chopper folding may be adjusted by providing the differential mechanism 96 in the drive system 95 for the conveyor belt 21 and adjusting the timing of conveyance of the signature 30 by the conveyor belt 21, as shown by a two-dot chain line in FIGS. 1 and 4. Alternatively, a differential mechanism 96 may be provided in each of the drive systems 90 and 95 to adjust the vertical movement of the chopper blade 12 and the conveyance of the signature 30 by the conveyor belt 21, respectively, to thereby adjust the timing of the chopper folding.

In the chopper folding machine 91 including only the timing correcting means 50, only a single beam sensor may be provided to detect a signature 30 to be folded.

While bad-folding detecting means 60 of the first embodiment detects the tilt of the signature 30 from the rotational angle of the chopper blade driving shaft 11, the tilt of the signature 30 may be detected from the difference between the times when the beam sensors 42 and 43 have sensed the signature 30, and the speed of the belt 21. The detection of the tilt of the signature from the rotational angle of the shaft 11 as in the first embodiment is advantageous because it can be performed irrespective of the speed of the conveyor belt 21.

The sensors are not limited to the beam sensors 42 and 43 and any sensors may be available so long as they are capable of sensing the leading edge of a signature 30 to be folded. The rotational angle detector is not limited to the encoder 41 and any detectors may be used so long as they are capable of detecting the rotational angle of the shaft 11.

The drive control means 53 is not limited to the motor 18 and the potentiometer 17. For example, it may be a generally used well-known pulse motor or an AC or DC servomotor available commercially and a microcomputer to control the pulse motor or the servomotor. It may be selected approximately when the invention is carried out.

As described above, according to the inventive chopper folding machine, the timing of chopper folding is performed in a continuous stepless limitless manner without stopping the machine.

If a differential gear mechanism is used as the differential mechanism, the latter is reduced in size and the space where it is installed is reduced, advantageously.

If the eccentric shaft of the differential gear mechanism is driven by a servomotor which is controlled by a computer, the timing of chopper folding is advantageously adjusted in accordance with the kind of the signature to be folded.

If a crank handle is attached to the eccentric shaft, the driving of the eccentric shaft or the timing of chopper folding may be adjusted manually.

As described above, according to the inventive chopper folding machine which includes timing correction means, the timing of chopper folding is corrected automatically to thereby prevent advantageously the production of badly folded articles due to deviation of the timing.

According to the chopper folder including bad-folding detecting means, bad products due to tilt of the corresponding signatures are detected automatically and inclusion of bad products with good ones is prevented advantageously.

What is claimed is:

1. A chopper folding machine comprising:

a chopper blade and a conveyor belt driven synchronously by a drive system. said chopper blade being moved vertically by rotation of a shaft;

timing adjusting means provided in said drive system for adjusting the timing of chopper folding, whereby vertical movement of said chopper blade with respect to the conveyance by the conveyor belt of a signature to be folded is adjusted;

timing correcting means for driving and controlling said timing adjusting means such that a deviation of the timing of chopper folding is detected and adjusted thereafter, said timing correcting means comprising:

a plurality of sensors capable of sensing an edge of the signature conveyed by the conveyor belt, at least two of said plurality of sensors being disposed along a line perpendicular to the direction in which the signature is conveyed by the conveyor belt;

a rotational angle detector capable of detecting the rotational angle of said shaft;

rotational angle detecting means for detecting the rotational angle of said shaft by means of said rotational angle detector when at least one of said plurality of sensors senses the signature;

timing adjusting quantity calculating means for calculating a timing adjusting quantity from the rotational angle detected by said rotational angle detecting means and from a preset value; and drive control means for driving and controlling said timing adjusting quantity calculating means in accordance with the calculated timing adjusting quantity; and bad-folding detecting means comprising:

tilt detecting means for detecting a tilt of an edge of the signature with respect to the direction in which the signature is conveyed, tilt detecting means receiving outputs from at least two of said plurality of sensors;

determining means for determining bad folding of the signature on the basis of the tilt of the edge of the signature detected by the tilt detecting means;

wherein said bad-folding detecting means;

calculates respective rotational angles of the shaft by means of said rotational angle detector when the plurality of sensors respectively sense the signature; and detects the tilt of the signature from the difference between the respective calculated rotational angles.

2. A chopper folding machine according to claim 1, wherein said tilt detecting means calculates the tilt of the signature from the difference between the times when the respective at least two of said plurality of sensors detect the signature and from the conveyance speed of the conveyor belt.

3. A chopper folding machine according to claim 1, wherein said timing adjusting means includes a differential mechanism.

4. A chopper folding machine according to claim 3, wherein the differential mechanism includes a differential gear mechanism.

5. A chopper folding machine according to claim 3, wherein the differential mechanism includes a timing belt.

6. A chopper folding machine comprising: a chopper blade and a conveyor belt driven synchronously by a drive system for a folding apparatus put in juxtaposition with a printing machine; and timing adjusting means provided in a drive system for at least one of the chopper blade and the conveyor belt for adjusting the timing of chopper folding, whereby the timing of the conveyance of a signature, to be folded, by the conveyor belt and of vertical movement of the chopper blade is adjusted, said timing adjusting means including a differential mechanism which includes a differential gear mechanism, the differential gear mechanism comprising:

an output gear fastened to a shaft connected to the drive system for the folded apparatus;

a first inner-tooth gear having outer teeth which mesh with the output gear, said first innertooth gear being supported rotatably on a non-eccentric portion of an eccentric shaft having an eccentric portion;

an eccentric gear meshing with the inner teeth of the first inner-tooth gear said eccentric gear being supported rotatably on the eccentric portion of the eccentric shaft; and a second inner-tooth gear having inner teeth which mesh with the eccentric gear, said second inner-tooth gear also having outer teeth which mesh with a gear train on the side of the chopper blade, said second inner-tooth gear being supported rotatably on the non-eccentric portion of the eccentric shaft;

wherein each of the first and second inner-tooth gears have different numbers of inner teeth, and wherein the inner teeth all have the same pitch, and wherein the chopper blade moves vertically via a gear train meshing with the outer teeth of the second inner-tooth gear.

7. A chopper folding machine according to claim 6, wherein the eccentric shaft of the differential gear mechanism is driven by a servomotor which is controlled by a computer.

8. A chopper folding machine according to claim 6, wherein the eccentric shaft of the differential gear mechanism is driven by the rotation of a crank handle attached removably to an end of the eccentric shaft.

9. A chopper folding machine including a chopper blade and a conveyor belt driven synchronously by a drive system, comprising:

a bad-folding detecting means which includes:

a plurality of sensors, provided so as to extend perpendicular to the direction in which a signature to be folded is conveyed by the conveyor belt, for sensing an edge of the signature;

tilt detecting means for detecting a tilt of the signature with respect to the direction in which an edge of signature is conveyed, in accordance with outputs from the respective plurality of sensors which sense the signature;

means for determining bad-folding of the signature on the basis of the tilt of the signature detected by the tilt detecting means;

a rotational angle detector for detecting the rotational angle of a shaft for moving the chopper blade vertically, and wherein the tilt detecting means calculates from the rotational angle detector the rotational angles of the shaft when respective sensors of the plurality of sensors sense the signature, and wherein the tilt detecting means detects the tilt of the signature from the difference between the rotational angles.

10. A chopper folding machine according to claim 9, wherein the tilt detecting means calculates the tilt of the signature from the difference between the times when respective sensors of the plurality of sensors sense the signature and the conveyance speed of the conveyor belt.

* * * * *